United States Patent [19]

Foreman et al.

[11] Patent Number: 4,620,692

[45] Date of Patent: Nov. 4, 1986

[54] CROWN BLOCK COMPENSATOR

[75] Inventors: Fred R. Foreman, London, England; Douglas W. J. Nayler, Mission Viejo, Calif.

[73] Assignee: NL Industries, Inc., New York, N.Y.

[21] Appl. No.: 666,874

[22] Filed: Oct. 31, 1984

[51] Int. Cl.[4] ..... E21B 19/09

[52] U.S. Cl. ..... 254/277; 254/392; 254/900

[58] Field of Search ..... 254/277, 392, 413, 900

[56] References Cited

U.S. PATENT DOCUMENTS

| | | | |
|---|---|---|---|
| 3,469,820 | 9/1969 | Horton | 254/277 |
| 3,799,505 | 3/1974 | Duncan | 254/274 |
| 3,804,183 | 4/1974 | Duncan et al. | 254/900 X |
| 3,841,770 | 10/1974 | Childs | 403/106 |
| 3,877,489 | 4/1975 | Louie et al. | 138/46 |
| 3,877,680 | 4/1975 | Childs et al. | 254/394 |
| 4,025,055 | 5/1977 | Strolenberg | 254/277 X |
| 4,272,059 | 6/1981 | Noerager et al. | 254/392 |

FOREIGN PATENT DOCUMENTS

| | | | |
|---|---|---|---|
| 2066762 | 7/1981 | United Kingdom | 254/277 |

OTHER PUBLICATIONS

Document entitled Crown Mounted Drill String Compensator by Maritime Hydraulics, undated.

Document identified as Crown Block Heave Compensator by Western Gear Corporation, undated.

*Primary Examiner*—Donald Watkins

*Attorney, Agent, or Firm*—Browning, Bushman, Zamecki & Anderson

[57] ABSTRACT

Disclosed is a compensator applicable for use with a traveling block supported from a mast, derrick or the like by means of a crown block wherein the traveling block may be utilized for supporting objects. Two fluid pressure piston-and-cylinder assemblies are arrayed on opposite sides of a line of travel of the traveling block relative to the crown block so that a flexible line positioned about the sheaves of both blocks passes over a pulley supported by one fluid pressure assembly to one side of the line of travel and, on the other side, the flexible line passes over a pulley supported by the other fluid pressure assembly. One end of the flexible line may be anchored relative to the mast as a deadline while the line at its other end may be selectively retracted or payed out by a drawworks or the like fixed relative to the mast. The crown block is supported by flexible lines passing over pulleys also supported by the fluid pressure assemblies. With the drawworks holding the first flexible line fixed, the crown block and the traveling block may move in unison relative to the mast with proportional reciprocable movement on behalf of each of the fluid pressure assemblies while the traveling block remains stationary relative to the crown block. Operation of the drawworks to retract or pay out the line results in manipulation of the traveling block relative to the crown block regardless of movement of the two blocks relative to the mast.

22 Claims, 9 Drawing Figures

FIG. 8
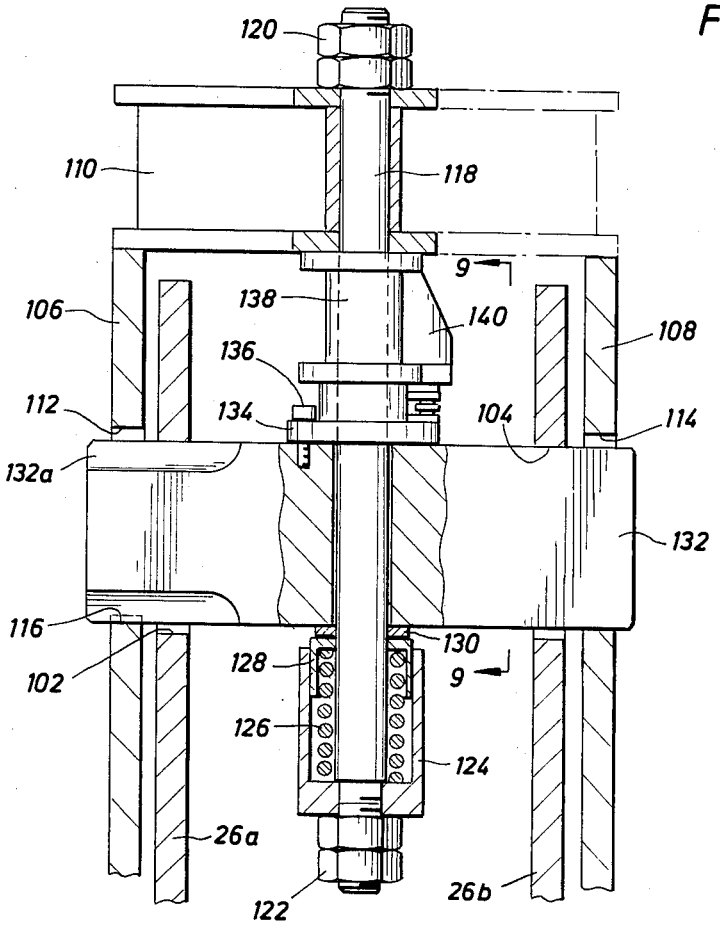
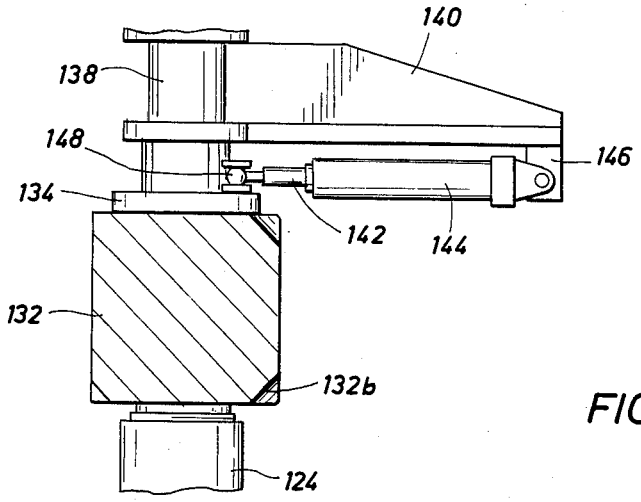
FIG. 9

CROWN BLOCK COMPENSATOR

BACKGROUND OF THE INVENTION

1. Field of the Invention

The present invention pertains to apparatus for supporting and manipulating equipment. More particularly, the present invention relates to support apparatus of the type utilizing blocks and lines, such as a traveling block, to which equipment may be connected, and a crown block from which the traveling block is suspended by means of a line arrayed between sheaves forming parts of the two blocks. The present invention finds particular application in environments wherein such block arrangements are supported by floating vessels and used to manipulate equipment relative to the floor of the body of water supporting the vessel, or in environments wherein soft landings of equipment are desired.

2. Description of Prior Art

Motion compensators are known for compensating for the vertical heaving of marine vessels supporting submerged equipment during drilling or other undersea well operations. Such compensators include traveling block compensators wherein a hook, elevator or the like by which equipment may be connected to a traveling block is suspended from the traveling block by means of fluid pressure assemblies which reciprocate to allow the hook to be maintained fixed relative to the undersea floor as the traveling block heaves with the derrick and floating vessel due to wave action for example. Such compensators require the weight of the compensation apparatus to be supported by the same line by which the traveling block is suspended from the crown block, which is fixed to the mast or derrick.

A motion compensator wherein the crown block is intended to remain stationary relative to the undersea floor as the derrick and floating vessel heaves has been designed whereby the crown block is supported from the derrick by means of a pair of direct-acting hydraulic piston-and-cylinder assemblies. However, additional compensation apparatus is required in that case to eliminate linear movement of the flexible line supporting the traveling block to prevent relative motion between the traveling block and the crown block as a result of heaving of the derrick.

It is desirable and advantageous to provide a crown block compensator supported from fluid pressure assemblies providing balanced support and positioned to minimize the required height of a derrick or mast supporting the crown block and traveling block combination. Similarly, it is desirable to provide like compensation to the line interconnecting the two blocks so that the traveling block and the crown block may remain stationary relative to the undersea floor as the derrick is heaved with the floating vessel with no additional compensation assemblies. The height of the derrick may be so minimized also by providing a mechanical advantage with the crown block compensator assemblies so that relatively large heave of the derrick may be compensated with lesser relative movement between the compensator assembly components.

SUMMARY OF THE INVENTION

The present invention provides apparatus for supporting and manipulating objects including first and second fluid pressure assemblies each comprising first and second mutually reciprocable bodies urged by fluid pressure in a first directional mode. The first bodies are fixed relative to a first object and the second bodies area connected to a second object whereby proportional, reciprocable motion between the first and second bodies accompanies relative motion between the first and second objects. A third object may be connected to and supported by the second object so that such relative motion between the first and second objects may occur while the third object remains stationary with respect to the second object, but also whereby the third object may be selectively moved relative to the second object regardless of motion between the first and second objects.

In a particular embodiment illustrated, the second and third objects are shown as first and second blocks, or a crown block and a traveling block, respectively, with each such block equipped with one or more sheaves about which a flexible line is passed. The first object is illustrated as a derrick or mast, it being understood that the first object may be any type of support structure. The first bodies of the fluid pressure assemblies are fixed relative to the mast while the second bodies carry pulleys about which the flexible line is arrayed toward opposite sides of the first and second blocks. Manipulation of the flexible line relative to the mast, for example, selectively manipulates the second block relative to the first block. The first block is connected to the second bodies carrying the pulleys so that relative motion between the first block and the mast is accompanied by reciprocable motion between the first and second bodies of the fluid pressure assemblies. Such connection between the first block and the second bodies may be by means of flexible lines fixed at one end thereof to the first block and fixed at the other end thereof relative to the first bodies and passing over other pulleys carried by the second bodies.

The flexible line arrayed about the sheaves of the first and second blocks may be anchored relative to the mast at one end of the line and arranged to be retracted or payed out relative to the mast toward the other end of the line to so manipulate the second block relative to the first block.

The present invention thus provides apparatus for supporting a crown block, for example, from a mast and a traveling block supported from the crown block wherein the traveling block may be maintained fixed relative to the crown block, or selectively moved relative to the crown block, while the crown block remains stationary relative to a reference as the mast is moved relative to the reference, with proportional movement between reciprocable components of fluid pressure assemblies supporting the two blocks relative to the mast.

BRIEF DESCRIPTION OF THE DRAWINGS

FIG. 8 is an enlarged sectional view taken along line 8—8 of FIG. 6, showing additional details of the lock bar assembly; and FIG. 9 is a sectional view taken along line 9—9 of FIG. 8 and illustrating details of the lock bar assembly.

DETAILED DESCRIPTION OF THE PREFERRED EMBODIMENT

Figure 1:
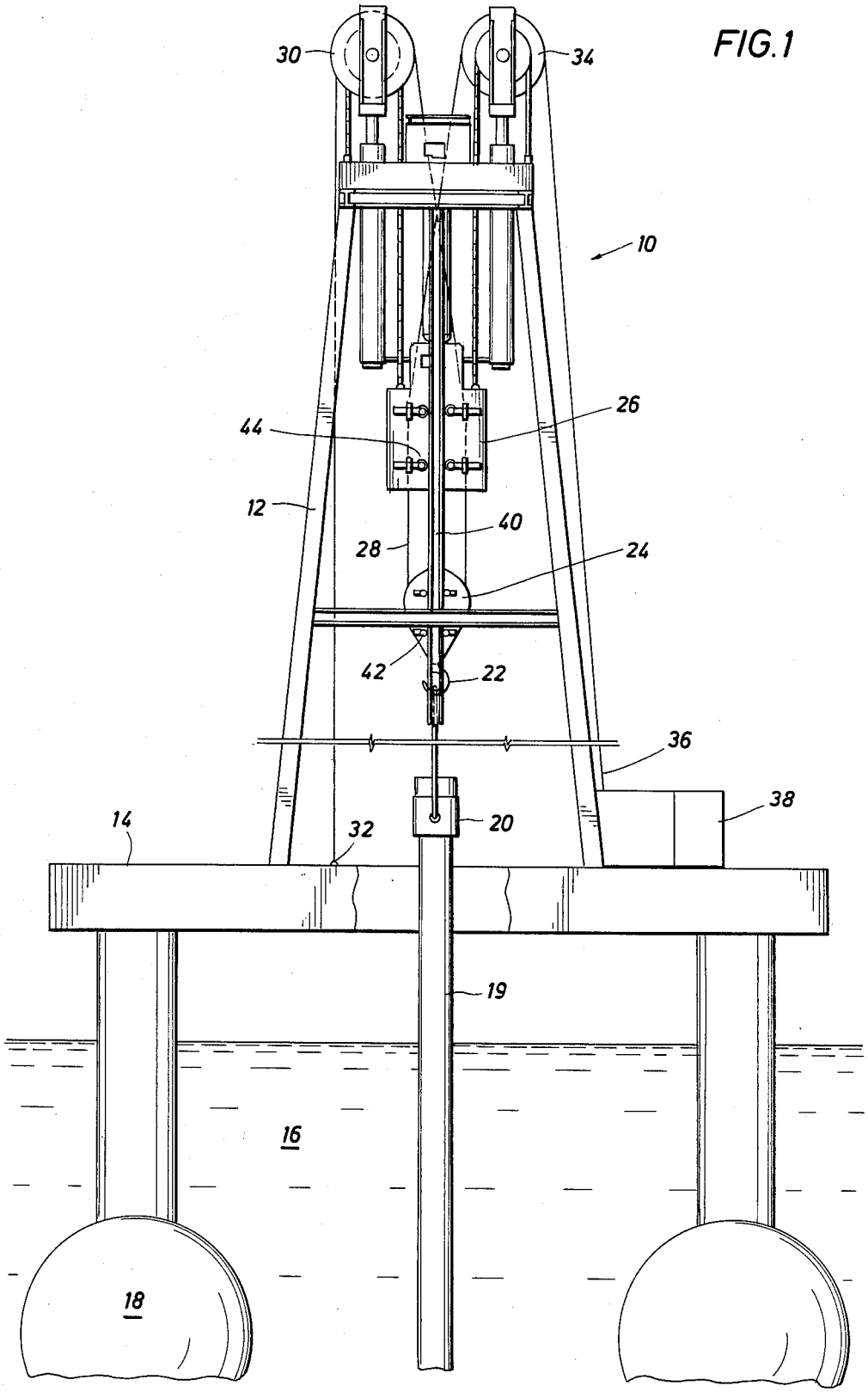
FIG. 1 is a side elevation, in partial section and partly schematic, of a semi-submersible platform with a derrick, or mast, supporting a crown block and a traveling block by means of a compensator according to the present invention.

Compensation apparatus according to the present invention is illustrated generally at 10 in FIG. 1 included in a drilling, or well working, system comprising a derrick, or mast, 12 mounted on a semi-submersible platform 14 supported by flotation devices 18 in a body of water 16. A tubular member 19, which may be a drill string, casing section, or any other equipment, is illustrated supported by an elevator 20 hanging by a hook 22 from a traveling block 24 by which the tubular member may be manipulated and lowered into, or withdrawn from, an underwater well (not shown), for example. During such operations on the well, the platform 14 may heave or otherwise move due to wave action or other such disturbances of the body of water 16. The compensation apparatus 10 accommodates such platform motion while allowing the tubular member 19 to be maintained fixed relative to the underwater floor and well, or to be selectively maneuvered relative to the seabed or well regardless of the heaving motion of the platform 14.

The traveling block 24 is supported from an upper, or crown, block 26 by a flexible line, or cable, 28 in a manner discussed in detail hereinafter. The line 28 passes over a pulley 30 to one side of the derrick 12 and is fixed at one end 32 of the line relative to the derrick and platform 14. The line 28 also passes over another pulley 34 and, toward the other end of the line at 36, is connected to a drawworks 38 which may be operated to selectively retract, or pay out, the line 28 relative to the drawworks, mast 12 and platform 14. Mounting of the pulleys 30 and 34 is discussed in detail hereinafter.

The derrick 12 includes a vertical track assembly 40 which is engaged by a plurality of rollers 42 and 44 carried by the traveling block 24 and the crown block 26, respectively, whereby the two blocks are guided and constrained during vertical movement of the blocks relative to the derrick.

Figure 2:
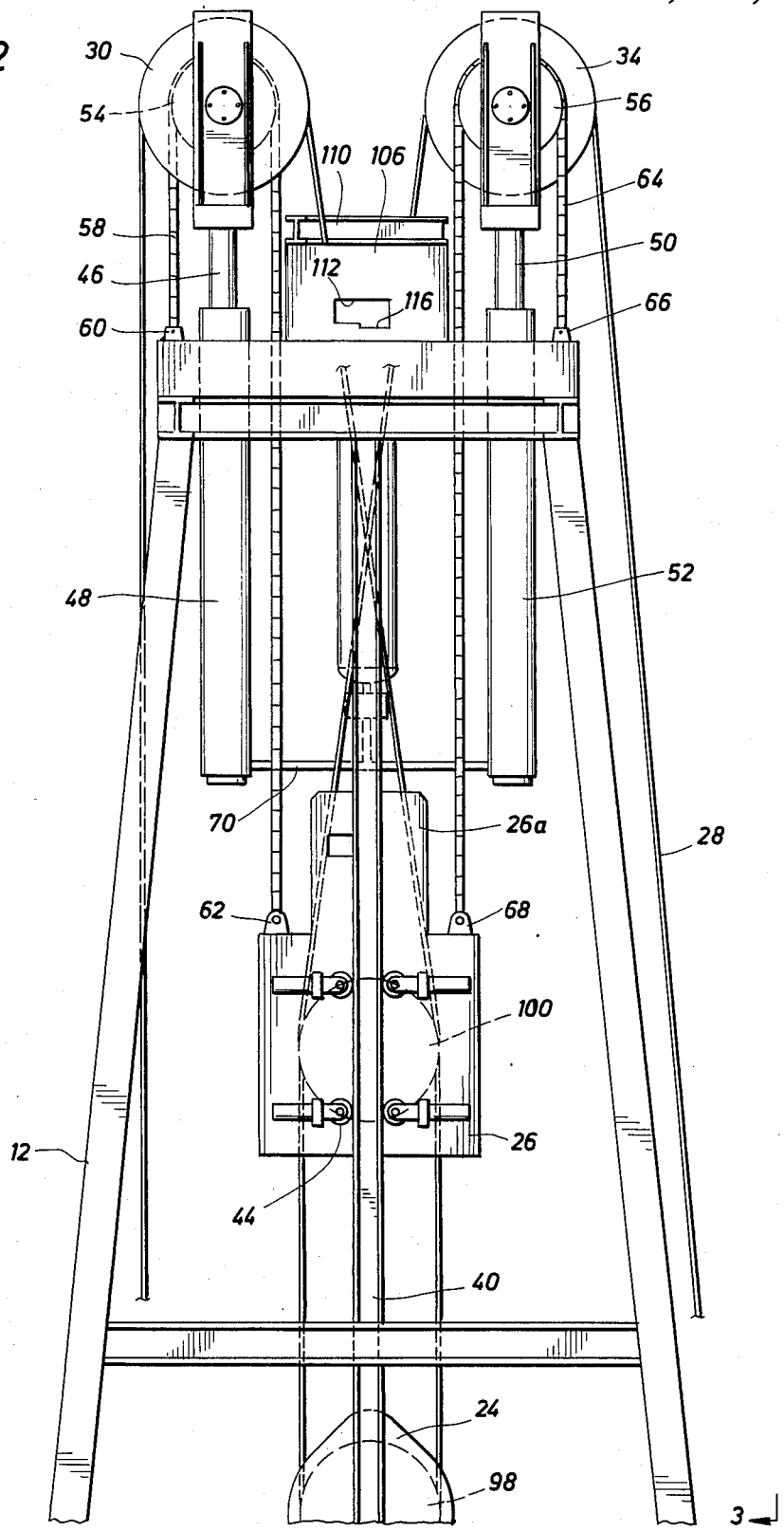
FIG. 2 is an enlarged view of the upper portion of the derrick of FIG. 1 with the derrick raised relative to the blocks.

As indicated in FIG. 2, the pulley 30 is mounted on a horizontally-oriented axle carried by a piston 46 vertically reciprocably movable relative to a cylinder 48 in a fluid pressure assembly. Similarly, the pulley 34 is mounted on a horizontal axle carried by a piston 50 movable relative to a cylinder 52 and providing another fluid pressure assembly. The two cylinders 48 and 52 are mounted fixed relative to the derrick 12 leaving the pistons 46 and 50 movable relative to the derrick.

A pulley assembly 54 is carried by an axle also supported by the piston 46, whereby the pulley 30 is free to rotate relative to the pulley assembly 54. A pulley assembly 56 is similarly carried by the piston 52 with the pulley assembly 56 rotatable relative to the pulley 34. A flexible line, cable or chain assembly, for example, 58 is anchored at one end thereof 60 to the derrick 12, extends over the pulley assembly 54 and is anchored at the opposite line end 62 to the crown block 26. A similar flexible line assembly 64 is anchored at one end thereof 66 to the derrick 12, passes over the pulley assembly 56 and is anchored at the other end of the line 68 to the crown block 26. The two line assemblies 58 and 64 thus support the crown block 26 from the derrick 12 by means of the pulley assemblies 54 and 56, respectively, providing a balanced support on opposite sides of the crown block. It will be appreciated that vertical movement of the pistons 46 and 50 relative to the derrick 12 accompanies vertical movement of the crown block 26 relative to the derrick, with the crown block movement twice that of the piston movement.

Figure 3:
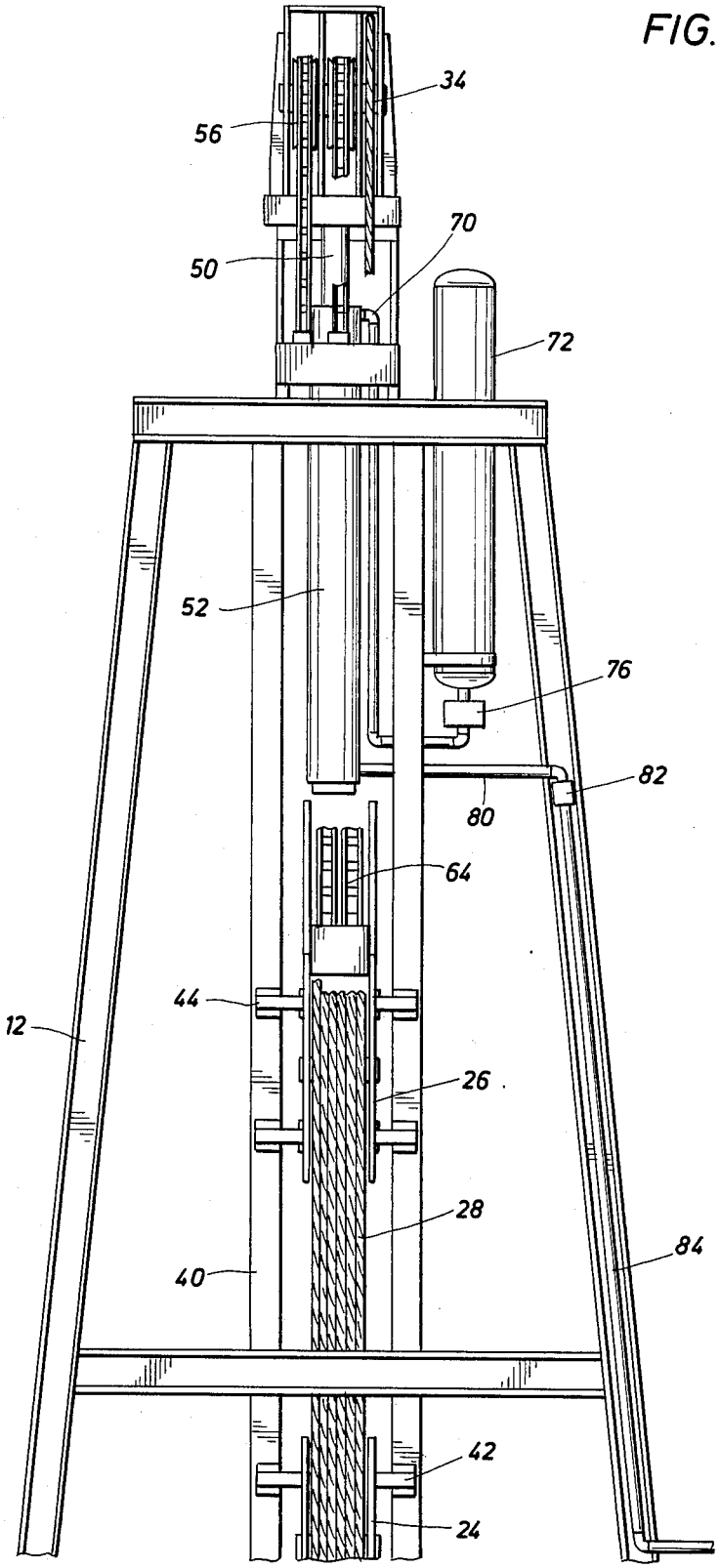
FIG. 3 is a side elevation of the derrick portion illustrated in FIG. 2.
Figure 5:
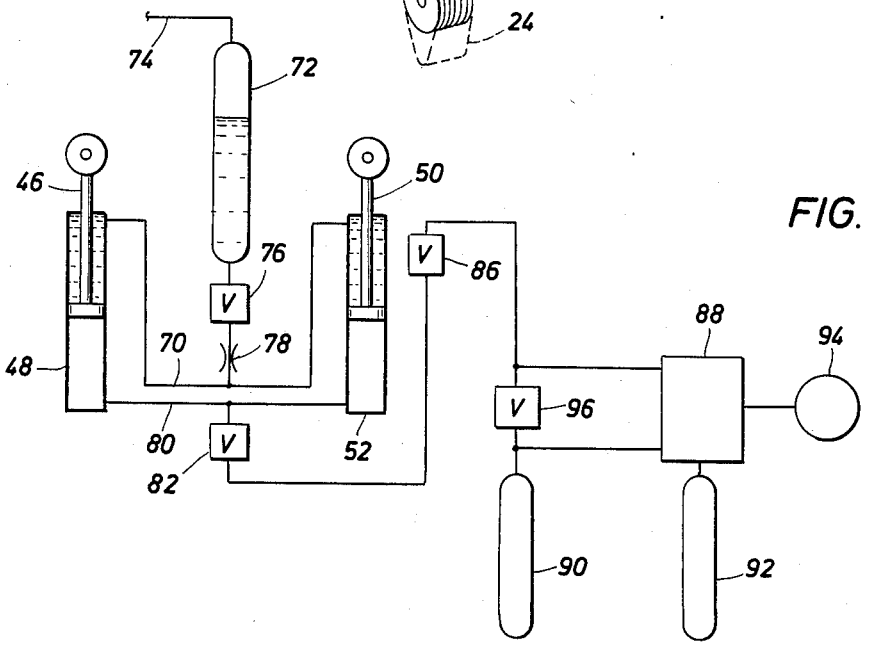
FIG. 5 is a schematic, block diagram of a fluid pressure system utilized to operate the fluid pressure assemblies of the compensator apparatus.

Operation of the pistons 46 and 50 may be further appreciated by reference to FIGS. 3 and 5 wherein it is indicated that the fluid pressure assemblies are partly hydraulic and partly pneumatic. The piston rod sides of the cylinders 48 and 52 are parts of a hydraulic system wherein these cylinder portions are connected by a hydraulic line system 70 to a reservoir 72 containing the hydraulic fluid topped by compressed gas to maintain the liquid under desired pressure. A gas pressure line 74 communicates between the top of the reservoir 72 and a supply (not shown) of the compressed gas. A locking valve 76, including a check valve bypass, is positioned in the hydraulic line between the reservoir 72 and the cylinders 48 and 52. A speed limiting valve (not shown) may be incorporated in the connection between each of the cylinders 48 and 52 with the hydraulic line system 70 to limit the rate of flow of hydraulic fluid between the reservoir 72 and the cylinders, as does an optional orifice indicated at 78, to prevent too rapid upward movement of the pistons 46 and 50 relative to the cylinders.

The fluid pressure cylinders 48 and 52 on the blind sides of the pistons are connected by a high pressure gas line system 80 to a locking valve 82 communicating with a standpipe 84 (FIG. 3) extending downwardly from the elevated position of the pistons on the derrick to a second valve 86, if necessary. The gas pressure communication system continues to a control console 88 whereby gas pressure may be selectively applied to the cylinders 48 and 52 from one or another of compressed air pressure vessels 90 and 92. An air compressor 94 also communicates with the console 88 for charging the vessels 90 and 92. A valve manifold 96 is available by which one of the air pressure vessels 90 may be communicated to the pistons 48 and 52, bypassing the console 88, if necessary.

Compressed air is provided to the blind sides of the cylinders 48 and 52 to urge the pistons 46 and 50, respectively, in a first directional mode, that is, to extend outwardly from the cylinders and tend to elevate the pulleys carried by the pistons. The hydraulic pressure applied to the rod sides of the cylinders 48 and 52 resists upward movement by the pistons 46 and 50 and provides a cushion against the force applied by the gas pressure on the blind sides of the cylinders.

Figure 4:
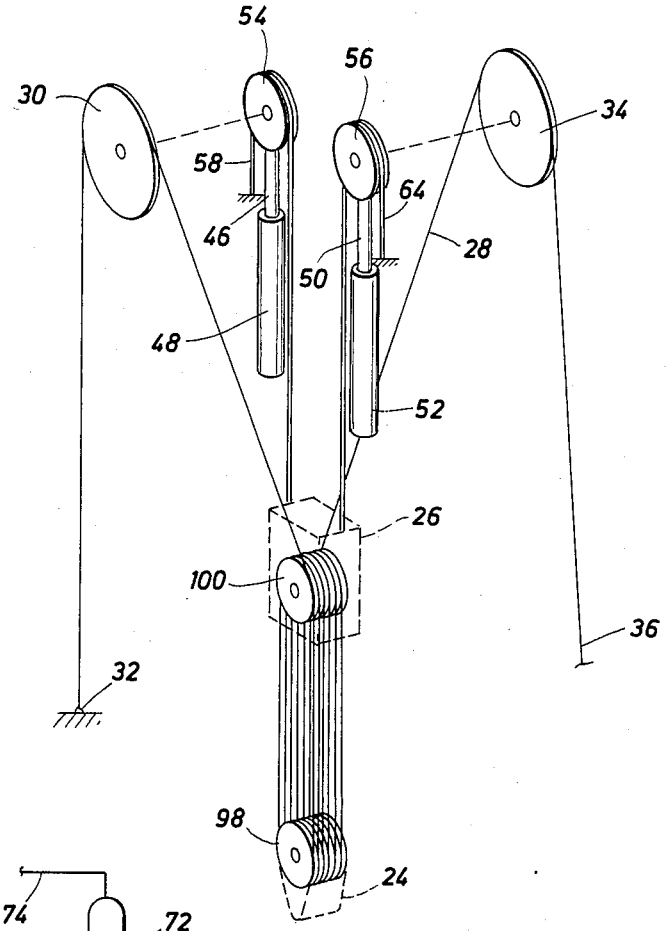
FIG. 4 is a schematic illustration showing various features of the blocks, lines, sheaves and pulleys of the compensator apparatus illustrated in FIGS. 1–3.

As may be appreciated by reference to FIGS. 2, 3 and 4, the traveling block 24 is equipped with a plurality of sheaves 98, the crown block 26 is equipped with a plurality of sheaves 100, and the flexible line 28 is arrayed alternately around the traveling block sheaves and the crown block sheaves between positions along the line wherein the line passes over the pulleys 30 and 34. With one end of the flexible line 28 anchored at 32 to provide a deadline, and the other end of the line 28 at 36 operable by the drawworks 38 as a fast line, the traveling block 24 is suspended from the crown block 26 by the flexible line 28 which thereby supports the traveling block from the derrick 12. Operation of the drawworks 38 to retract or pay out the cable 28 maneuvers the traveling block toward or away from, respectively, the crown block 26.

The crown block 26 is supported by the mast 12 by means of the pistons 46 and 50 supported on air pressure within the cylinders 48 and 52, respectively. With the pneumatic pressure in the cylinders 48 and 52 balancing the load supported by the pistons 46 and 50, respectively, which load includes the two blocks 24 and 26 and equipment supported thereby, such as the tubular member 18 (FIG. 1), downward movement of the cylinders 48 and 52 with the derrick 12 and floating platform 14 tending to lighten the load on the cylinder air supply results in the pistons 46 and 50 moving upwardly relative to the cylinders, maintaining the crown block 26 and all components supported thereby stationary. As the derrick 12 and platform 14 rise with the wave motion, for example, the increased load on the cylinder air supply causes the pistons 46 and 50 to drop downwardly relative to the cylinders 48 and 52, respectively, with the result that the derrick 12 rises relative to the crown block 26 and all components supported thereby.

As the pistons 46 and 50 move upwardly or downwardly within the cylinders 48 and 52, respectively, the hydraulic fluid flows between the rod side of the cylinders and the reservoir 72 as needed to maintain the cylinders full of fluid. Thus, vertical heaving of the derrick 12 relative to the sea floor, for example, is compensated by action of the pistons 46 and 50 relative to the cylinders 48 and 52 whereby the crown block 26 remains stationary relative to the seabed.

Additionally, as the pistons 46 and 50 are moved vertically relative to the heaving derrick, corresponding vertical movement with the pistons of the pulleys 30 and 34 ride the pulleys along the flexible line 28. As the deadline anchor 32 and the drawworks anchor 36 rise relative to the crown block 26, the pulleys 30 and 34 retract toward the cylinders 48 and 52, respectively, maintaining the line 28 stationary at the blocks 24 and 26. Similarly, as the deadline and drawworks anchors 32 and 36, respectively, fall with the derrick fall, the pulleys 30 and 34 extend from the cylinders 48 and 52, respectively, to maintain the line 28 stationary at the blocks 24 and 26. Since the flexible line pulleys 30 and 34 move with the crown block support pulley assemblies 54 and 56, the traveling block 24 remains stationary relative to the crown block 26 as the derrick 12 heaves upwardly and downwardly as long as the drawworks 38 are not operated to retract or pay out the flexible line 28. Further, even with the derrick 12 heaving relative to the crown block 26, the latter remaining stationary with respect to the sea floor, the drawworks 38 may be operated to raise and lower the traveling block 24 relative to the crown block regardless of the vertical movement of the derrick.

As indicated, the flexible line 28 passing over the pulley 34 extends to the far side of the crown block 26 to wrap around the block sheaves 98 and 100 in a clockwise fashion, as viewed in FIG. 2 for example, with the returning line passing over the other pulley 34 and downwardly to the drawworks 38 from the opposite side again of the crown block 26. Thus, all turns experienced by the line 28 going about the pulleys 30 and 34 and the sheaves 98 and 100 are in the same rotational sense, thereby avoiding possible wear effects which might result if the line alternately experienced bends in the opposite rotational sense. The relatively large diameters of the pulleys 30 and 34 also helps to extend the useful life of wire cable or the like, serving as the line 28, for example. Also, with the two pulleys 30 and 34 mutually offset, the crossing of the line 28 between the crown block 26 and the pulleys occurs with the offset spacing the crossed line portions.

The angles which the line 28 makes with the vertical extension of the lines 58 and 64 between the pulley assemblies 54 and 56, respectively, and the crown block 26 are sufficiently small to make negligible any difference in extension in that region of the flexible line 28 compared to the crown block support lines 58 and 64 as the derrick 12 heaves.

The hydraulic locking valve 76 and the pneumatic locking valve 82 my be closed simultaneously (from the control 88, for example) to lock the pistons 46 and 50 at any desired position relative to the cylinders 48 and 52 by preventing flow of fluid relative to the cylinders. The bypass feature of the hydraulic valve 76 permits one-way leakage of liquid into the cylinders 48 and 52 to prevent cavitation as the otherwise locked pistons 46 and 50 settle on the confined gas in the cylinders.

Figure 6:
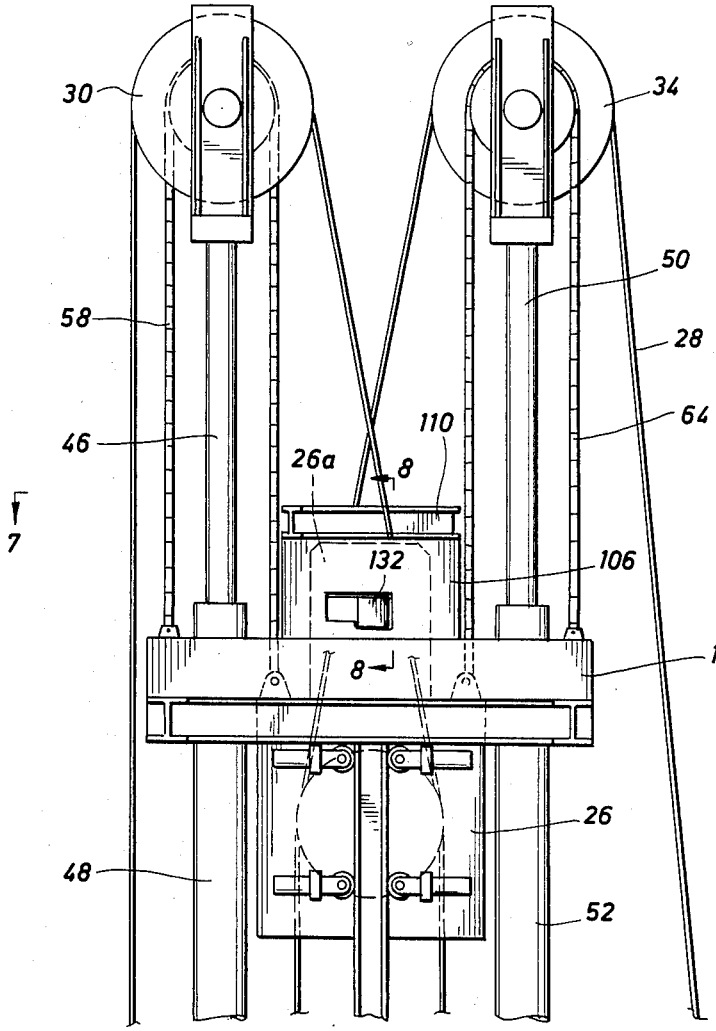
FIG. 6 is a view similar to FIG. 2, but fragmentary and illustrating the pistons of the fluid pressure assemblies extended and the crown block anchored to the derrick by a lock bar assembly.
Figure 7:
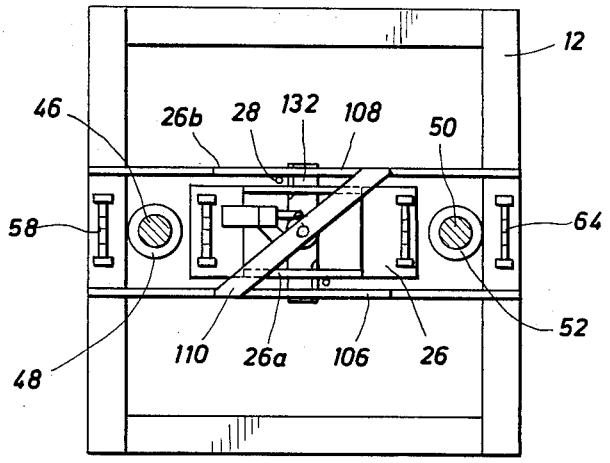
FIG. 7 is a horizontal cross section taken along line 7—7 of FIG. 6, showing details of the lock bar assembly.

The crown block 26 extends upwardly on both sides of the sheave assembly 100 in plates **26*a* and 26*b* (FIG. 8), with the plates exhibiting horizontally-extending holes 102 and 104, respectively. In the raised configuration of the crown block 26 relative to the cylinders 48 and 52 as illustrated in FIGS. 6, 7 and 8, the crown block plates 26*a* and 26*b* pass between vertically oriented plates 106 and 108 as part of the derrick structure. A diagonally-extending beam 110 is supported by the derrick plates 106 and 108. Horizontally-extending holes 112 and 114 are features of the derrick plates 106 and 108, respectively. At least one of the holes 112 and 114 exhibits a depression along the bottom edge thereof, with hole 112 showing a depression 116** in the present illustrations.

A lock bar mechanism, generally along the lines disclosed in U.S. Pat. No. 3,841,770, which is incorporated herein by reference, is supported by the cross beam 110. Details of the locking mechanism, which serves to anchor the crown block 26 to the derrick 12 in the raised configuration of the crown block relative to the cylinders 48 and 52, may be further appreciated by reference to FIGS. 7–9. A shaft 118 passes through an appropriate bore in the cross beam 110 and is held against downward movement relative thereto by nuts 120. Similar nuts 122 threaded to the bottom of the shaft 118 support a generally cylindrical, open-topped housing 124 which encloses a coil spring 126 circumscribing the shaft 118 and covered by a top cap 128. The cap 128 is movable as the spring is compressed or expands. A bushing 130 separates the top cap 128 from a horizontally-extending lock bar 132. The compressed coil spring 126 provides a cushion for limited downward movement of the lock bar 132 relative to the shaft 118 during operation of the locking mechanism.

A flange 134 is rotationally locked to the lock bar 132 by a screw 136 to accommodate the limited vertical movement of the lock bar relative to the shaft 118. A framework 138 is mounted on the shaft 118 by the latter passing through a vertical bore of the framework. An arm 140 extends horizontally as part of the framework 138 and supports a combination of a piston 142 and a cylinder 144. One end of the cylinder 144 is pivotally connected to a bracket 146 extending from the arm 140 and the far end of the piston rod 142 is pivotally connected to the flange 134 by a pin connection 148. Application of fluid pressure to the piston-and-cylinder assembly 142/144 to extend or retract the piston relative to the cylinder results in rotation of the flange 134 and, therefore, of the lock bar 132, around the longitudinal axis of the shaft 118.

With the crown block 26 in the raised configuration of FIGS. 6–8, the crown block plate holes 102 and 104 generally align with the derrick plate holes 112 and 114. Then, the piston and cylinder combination 142/144 may be operated to rotate the lock bar 132 to an orientation perpendicular to the plate holes 102, 104, 112 and 114. The lock bar is sized to extend through all four holes as illustrated. Then, the lock bar 132 may support the weight of the crown block 126, and components supported thereby, upon relaxation of pneumatic pressure to the cylinders 48 and 52, if necessary. In such anchored configuration, greater weight may be supported by the crown block 26 than would otherwise be available with the crown block suspended only by the flexible line assemblies 58 and 64 and the pistons 46 and 50.

The vertical extension of the lock bar 132 is less than that of any of the holes 102, 104, 112 and 114 to facilitate movement of the lock bar into and out of the holes. Also, the leading edges of the lock bar 132 passing into the holes are beveled at **132*a* and 132*b* to facilitate engagement of the lock bar within the holes. The bar 132 is also rockably mounted on the shaft 118 by the latter passing through a bore in the bar with the bore diameter slightly larger than the shaft diameter to allow the bar to shift, if necessary, to distribute weight to both derrick plates 106 and 108. At least one hole, such as 112 as illustrated, has a depression 116 which can accommodate the lock bar 132 in its perpendicular configuration relative to the plate 106 whereby the lock bar sitting in the depression would be prevented from being inadvertently rotated out of the holes 102, 104, 112 and 114**.

With the weight of the crown block 26 borne by the line assemblies 58 and 64 and the pistons 46 and 50, and the crown block raised sufficiently for the spring 126 to lift the lock bar 132 clear of the hole depression 116, the piston-and-cylinder combination 142/144 may be operated to rotate the lock bar 90° out of the plate holes 102, 104, 112 and 114 to a configuration parallel to the plates **26*a*, 26*b*, 106 and 108. Then, the crown block 26 may be lowered relative to the cylinders 48 and 52 by a controlled relaxation of pneumatic pressure applied thereto to configure the compensation apparatus in operating status. It will be appreciated that the lock bar 132 is clear of the flexible line 28 in the anchoring configuration of FIG. 7, and is also clear of the flexible line 28 in operating configuration of the compensation mechanism wherein the lock bar is oriented perpendicular to the configuration illustrated in FIG. 7**.

With the crown block 26 locked to the derrick 12 by the lock bar 132, the traveling block 24 may still be operated to raise and lower loads relative to the crown block by operation of the drawworks 138 to manipulate the line 28 relative to the two blocks 24 and 26. Also, the line pulleys 30 and 34 may be attached to a framework (not shown) extending as part of the derrick 12 to support these pulleys with the crown block anchored to the derrick, whereby the fluid pressure assemblies (46, 48, 50 and 52) may be serviced, disengaged, dismantled, or removed, in whole or in part, while the blocks 24 and 26 are still operational to manipulate loads.

If the fluid pressure assemblies (46, 48, 50 and 52) are incapacitated, the drawworks 138 may be operated to retract the line 28 to raise the traveling block 24 up to the crown block 26. Further retraction of the line 28 lifts both blocks, the traveling block 24 carrying the crown block 26. In this way, the line 28 can be used to raise the crown block 26 to align the crown block plates **26*a* and 26*b* with the derrick plates 106 and 108, whereby the lock bar 132 can be operated to anchor the crown block to the derrick 12** as described hereinbefore.

The motion compensation mechanism of the present invention provides a balanced support for the crown block 26 in that the crown block is suspended from line assemblies 58 and 64 attached at either end of the crown block and passing over pulley assemblies 54 and 56 carried by the pistons 46 and 50 positioned beyond opposite ends of the crown block. Further, the pistons 46 and 50 travel in paths parallel to the line of travel of the crown block 26 relative to the derrick 12 and of the traveling block 24 relative to the crown block and to the derrick. The support of the flexible line 28, which interengages the traveling block 24 with the crown block 26, by the pulleys 30 and 34 carried by the same pistons 46 and 50 which support the crown block 26, allows for relative movement between the traveling block and the derrick in the same action which allows for relative movement between the crown block and the derrick to compensate for movement of the derrick relative to the referenced seabed. Thus, no additional compensation mechanism is required to allow the traveling block 24 to be maintained fixed, or selectively moved, relative to the crown block 26 as the derrick 12 is heaved relative to the seabed. The compensation system may also be utilized to provide a cushioned, or soft, landing for equipment lowered by the blocks without movement of the derrick. It will be appreciated that construction of the cylinders 48 and 52 whereby the crown block 26 may be raised between the cylinders does not require undesirable upward extension of the derrick 12.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. Compensator apparatus comprising:

a. first and second fluid pressure apparatus, wherein each fluid pressure apparatus includes first and second mutually reciprocable bodies, and means associated with both fluid pressure apparatus for applying fluid pressure between said bodies tending to coincidentally reciprocate said bodies in a first directional mode, said first bodies being fixed relative to a first object;

b. means for connecting said second bodies with a second object so that parallel, proportional reciprocable motion between said first and second bodies accompanies relative motion between said first and second objects;

c. means for connecting said second object with a third object depending therefrom by such means whereby said third object is selectively movable relative to said second object independent of said reciprocable motion between said first and second bodies and wherein said relative motion between said first and second objects may be accompanied by like motion between said third object and said first object, said third object remaining relatively stationary with respect to said second object.

2. Apparatus as defined in claim 1 further comprising means associated with said first and second bodies for applying fluid pressure to said first and second bodies to resist reciprocation of said bodies in said first directional mode while permitting such reciprocation.

3. Apparatus as defined in claim 1 wherein said first and second fluid pressure apparatus each comprise fluid pressure piston-and-cylinder assemblies and which assemblies are arranged in parallel on opposite sides of a line of movement of said second and third objects relative to said first object.

4. Apparatus as defined in claim 3 further comprising pulleys carried by said second bodies, and wherein said means for connecting said second and third objects comprises flexible line means arrayed about one or more sheaves carried by each of said second and third objects and about said pulleys carried by said second bodies.

5. Apparatus as defined in claim 1 further comprising means for selectively anchoring said second object relative to said first object.

6. Apparatus as defined in claim 1 wherein said first object may move relative to a reference while said second object remains stationary relative to said reference and said second bodies move proportionately relative to said first object.

7. Apparatus for supporting and manipulating objects comprising:

a. first and second blocks, each equipped with one or more sheaves for mutual engagement of said blocks by a flexible line whereby said second block may be supported from said first block and selectively moved with respect thereto by means of said line so that objects supported by said second block may be so manipulated relative to said first block;

b. first and second fluid pressure assemblies, each such assembly comprising first and second reciprocable bodies, and fluid pressure means for applying fluid pressure to said fluid pressure assemblies to urge said reciprocable bodies in a first directional mode, said first and second assemblies being positioned on opposite sides of, and generally parallel to, a line of travel of said second block relative to said first block with said first directional mode generally parallel to said direction of movement;

c. pulleys carried by each of said second bodies with said flexible line arrayed about each said pulley and such that said line thus supports said second block from said pulleys; and d. means connecting said first block to said second bodies whereby movement of said first and second blocks in unison relative to said second bodies is accompanied by proportional reciprocable motion between said respective first and second bodies.

8. Apparatus as defined in claim 7 further comprising means for selectively manipulating said line means relative to said first bodies for selectively manipulating said second block relative to said first block.

9. Apparatus as defined in claim 7 further comprising means for selectively anchoring said first block relative to said first bodies.

10. Apparatus as defined in claim 7 wherein said first bodies may move relative to a reference while said first block remains stationary relative to said reference and said second bodies move proportionately relative to said first bodies.

11. A compensator for use with a crown block and a traveling block supported by a mast, comprising:

a. two fluid pressure assemblies, each including a piston component and a cylinder component with one such component fixed relative to said mast and the other such component carrying a pulley and reciprocably movable relative to said first component and therefore said mast;

b. means for applying fluid pressure to each of said fluid pressure assemblies tending to extend said fluid pressure assemblies and elevate said pulleys relative to said mast;

c. a crown block including one or more sheaves, and a traveling block including one or more sheaves;

d. a flexible line passing over one of said pulleys and arrayed alternately about said sheaves of said crown block and said traveling block and passing over the other of said pulleys whereby forces applied to the two ends of said flexible line provide support, by means of said pulleys and said mast, to said crown block and said traveling block suspended therefrom by said line; and e. means for connecting said crown block to said other components carrying said pulleys whereby said traveling block and said crown block are movable relative to said mast with proportional reciprocable motion between said piston and cylinder components of said fluid pressure assemblies while said traveling block may be fixed relative to said crown block.

12. Apparatus as defined in claim 11:

a. wherein one end of said flexible line is fixed relative to said mast; and b. further comprising means for selectively retracting or paying out said flexible line toward the opposite end thereof relative to said mast for selectively manipulating said traveling block relative to said crown block.

13. Apparatus as defined in claim 11 further comprising means for selectively anchoring said crown block relative to said mast.

14. Apparatus as defined in claim 13 wherein said flexible line may be operated to selectively manipulate said traveling block relative to said crown block while said crown block is so anchored relative to said mast.

15. Apparatus as defined in claim 11 wherein said mast may move relative to a reference while said crown block remains stationary relative to said reference accompanied by such proportional motion between said piston and cylinder components.

16. Apparatus as defined in claim 11 wherein said means connecting said crown block to said components carrying said pulleys comprise flexible line means, in each case fixed at one end thereof to said crown block and fixed at the opposite and thereof relative to said components not carrying said pulleys, and passing about one or more other pulleys carried with said first pulleys.

17. Apparatus as defined in claim 11 wherein said flexible line passes over both said pulleys and about said crown block sheaves and said traveling block sheaves in the same rotational sense.

18. Apparatus as defined in claim 11 wherein:

a. said means for connecting said crown block to said other components carrying said pulleys may be operated separately from said pulleys over which said flexible line passes; and b. further comprising means for operating said flexible line for selectively manipulating said traveling block relative to said crown block, operable independently of said means for connecting said crown block to said other components carrying said pulleys.

19. Apparatus as defined in claim 11 wherein said two fluid pressure assemblies are sufficiently mutually spaced whereby said crown block may move between said fluid pressure assemblies.

20. Apparatus as defined in claim 11 wherein said pulleys over which said flexible line passes may be held against longitudinal movement relative to said mast independently of said fluid pressure assemblies, and while said flexible line may be selectively operated for selectively manipulating said traveling block relative to said crown block.

21. Apparatus as defined in claim 11 wherein said flexible line may be operated to raise said traveling block to said crown block, and thereby raise both said traveling block and said crown block relative to said mast.

22. Apparatus as defined in claim 11 further comprising fluid locking valve means for selectively locking said piston component relative to said cylinder component of each of said fluid pressure assemblies by preventing fluid flow relative to said cylinder components.

* * * * *